US005431289A

United States Patent [19]

Hoffman

[11] Patent Number: 5,431,289

[45] Date of Patent: Jul. 11, 1995

[54] PRODUCT CONVEYOR

[75] Inventor: Philip L. Hoffman, Medford, Oreg.

[73] Assignee: Simco/Ramic Corporation, Medford, Oreg.

[21] Appl. No.: 196,581

[22] Filed: Feb. 15, 1994

[51] Int. Cl.[6] ..... B07C 5/00

[52] U.S. Cl. ..... 209/638; 209/639; 209/576; 198/494; 198/836.1; 198/839

[58] Field of Search ..... 209/639, 638, 576, 577, 209/580; 198/494, 836.1, 839

[56] References Cited

U.S. PATENT DOCUMENTS

| | | | |
|---|---|---|---|
| 1,422,002 | 7/1922 | Shaw | 198/836.1 |
| 2,784,834 | 3/1957 | Trinkle | 198/839 |
| 4,485,912 | 12/1984 | Carmichael et al. . | |
| 4,889,241 | 12/1989 | Cogan et al. | 209/639 X |
| 5,048,674 | 9/1991 | Wilbur et al. | 209/639 X |
| 5,085,325 | 2/1992 | Jones et al. | 209/580 |

*Primary Examiner*—David H. Bollinger
*Attorney, Agent, or Firm*—Stoel Rives Boley Jones & Grey

[57] ABSTRACT

A conveyor system for transporting and aligning articles to be sorted in an automated bulk processing system is disclosed. The conveyor comprises one or more product-carrying lanes, each lane comprising two side belts separated by a central product-carrying belt. Each of the side belts is raised with respect to the product-carrying belt, thereby guiding articles on to the product-carrying belt. In a preferred embodiment, the product-carrying belt has two product-carrying surfaces and is provided with a 180° lengthwise twist whereby the product-carrying surfaces are alternately presented on the upper surface of the conveyor system for each complete belt travel cycle. The 180° lengthwise twist is maintained in position by a belt guide or comb located on the underside of the conveyor system.

29 Claims, 4 Drawing Sheets

PRODUCT CONVEYOR

TECHNICAL FIELD OF THE INVENTION

The present invention relates generally to automated bulk processing equipment for inspecting and sorting articles and, in particular, to conveyor systems for transporting articles sorted by such equipment.

Background of the Invention

Automated bulk processing equipment rapidly inspects and sorts bulk articles including raw or processed fruit, vegetables, wood chips, recycled plastics and other similar products. Typically, articles are transported along a conveyor and inspected optically by means of a photo-electric detector. The articles can be characterized optically and sorted according to size, color, shape or other qualities. For example, stems and debris can be separated from fruit, fruit and vegetables can be reliably graded and sorted, undercooked potato chips can be distinguished and separated from fully cooked potato chips, and discolored or otherwise defective articles can be separated. Elongated articles such as french fries can be inspected both for uniformity of length and for defects by a length and defect analyzer (LDA) and sorted accordingly. Modern bulk optical processing equipment can rapidly separate very large quantities of articles into numerous categories.

Such equipment typically includes a conveyor system that moves articles in a single layer past an inspection station where cameras or other detection devices examine the articles. The inspection station sends signals to a sorting or treatment station where the articles are sorted or otherwise treated according to information received from the inspection station. For example, foreign or defective articles may be removed from the flow of articles carried by the conveyor system. Typically, unacceptable articles are removed by directing an accurately timed blast of fluid, such as compressed air, at the article as it is projected from the conveyor belt in order to direct it out of the process flow. Separation takes place at a location in the transport system where the articles are unsupported so that defective articles can easily be removed from the stream. Acceptable articles are received in an outfeed receiving location, while unacceptable articles are directed into a reject receiving location.

Conveyor systems used for rapid inspection and sorting of large quantities of articles typically comprise a single continuous or endless conveyor belt that carries articles at speeds of over 10 ft/sec (3.1 m/sec). One type of conventional automated bulk processing system including a conventional conveyor and off-belt inspection system is illustrated in FIG. 1. An article infeed system 10 delivers articles to a conveyor belt 12 moving in a direction 14 at a velocity high enough to project articles from the conveyor belt 12 in a trajectory 16 toward an outfeed receiving 18. The articles pass through an off-belt optical inspection station 20 comprising light modules 22 and 22' operably connected to a camera module 24. Unacceptable articles are removed from the flow of articles along trajectory 16 at an unacceptable article removal station by means of a fluid blast emanating from a fluid ejection manifold 26 which diverts the article in a direction 28 out of trajectory 16 and into a reject receiving location 30.

When inspecting articles off-belt for both uniformity of length and for defects, it is important that the articles are projected from the conveyor in a single layer aligned in a specific orientation, preferably parallel to the direction of movement of the conveyor. A problem with conventional conveyor systems driven at high speeds is that the articles are delivered to the conveyor belt in random orientations and are not aligned prior to being projected from the conveyor. In addition, many articles are relatively unstable on the conveyor belt and tend to move laterally across the belt in addition to rolling, tumbling, bouncing and colliding with each other resulting in misalignment of the articles as they traverse the inspection station. This misalignment makes it difficult to accurately and reliably determine the length of articles and distinguish defective articles. Misalignment of the articles also results in incorrect separation of defective articles by the sorting station.

U.S. Pat. No. 4,485,912 discloses a conveyor system for aligning articles prior to on-belt inspection in which the articles are directed into channels on an article feed bed before being received on a conveyor. The conveyor comprises a plurality of narrow belts which initially form a corrugated surface and subsequently flatten to form a level surface as the articles pass the inspection station.

When processing food items, such as french fries, cleanliness of the operation is an important consideration. Conventional conveyor systems are difficult to clean. Typically the conveyor belt is washed with running water directed onto the underside of the conveyor system. Minimal use of running water is preferred, so as to minimize carry-over of water from the underside to the upper side of the conveyor.

SUMMARY OF THE INVENTION

An objective of the present invention is therefore to provide a conveyor system for use in automated bulk processing equipment that improves the accuracy and efficiency of article sorting operations.

Another objective of the present invention is to provide such a conveyor system that maintains alignment of articles as they traverse the inspection station.

A further objective of the present invention is to provide such a conveyor system that maintains articles in a single layer.

Yet another objective of the present invention is to ensure cleanliness of the processing operation without excessive use of running water and without the subsequent carry-over of water from the underside of the belt to the upper surface of the conveyor. Carry-over of water results in water passing through the inspection station, thereby obstructing viewing and fouling the light modules.

These and other objectives are achieved according to the present invention by a conveyor system which comprises one or more lanes of belts, each lane comprising two continuous or endless side belts separated by an endless central product-carrying belt. All three belts are driven by a single infeed roller and therefore move in the same direction at the same speed. The side belts are raised with respect to the central product-carrying belt, thereby defining a recessed area with the product-carrying belt forming the base of the recess. Articles transported on the conveyor system are guided into this recessed area by the side belts and are thus aligned on the central product-carrying belt prior to being projected from the end of the conveyor system towards the inspection station. In a preferred embodiment, the conveyor system comprises three lanes of belts, each lane consisting of two round side belts and one flat product-carrying belt, which are supported by a routed tray, or platen.

In a preferred embodiment, the flat central product-carrying belt has two product-carrying surfaces and is provided with a 180° lengthwise twist which is located on the underside of the conveyor system. The two product-carrying surfaces are thus alternately presented on the upper surface of the conveyor for each complete belt travel cycle. This facilitates cleaning of the product-carrying surface by a means of a water spray on the underside of the conveyor system.

A separator or comb is provided on the underside of the conveyor system to maintain the side and product-carrying belts in the correct relative positions and to facilitate cleaning of the belts. In a preferred embodiment, the product-carrying belt passes through a guide or belt groove on the upper edge of the comb while the side belts pass through belt grooves on the lower edge of the comb. Separation of the belts by the comb prevents the product-carrying belt from crawling over the side belts. Use of the comb also prevents propagation of the 180° lengthwise twist along the length of the product-carrying belt. The twist is thus maintained in position on the underside of the conveyor system between the end roller and the comb.

In addition, the separation of the product-carrying belt from the side belts removes debris from between the side margins of the product-carrying belt and the side belts, thereby minimizing the amount of water required for cleaning and the subsequent carryover of water to the upper surface of the conveyor system. In a preferred embodiment, the side belts and product-carrying belt are composed of a non-stick material, such as urethane, thereby eliminating the need to use water for cleaning the belts.

The above-mentioned and additional features of the present invention and the manner of obtaining them will become apparent, and the invention will be best understood by reference to the following more detailed description, read in conjunction with the accompanying drawings.

DESCRIPTION OF PREFERRED EMBODIMENTS

Figure 1:
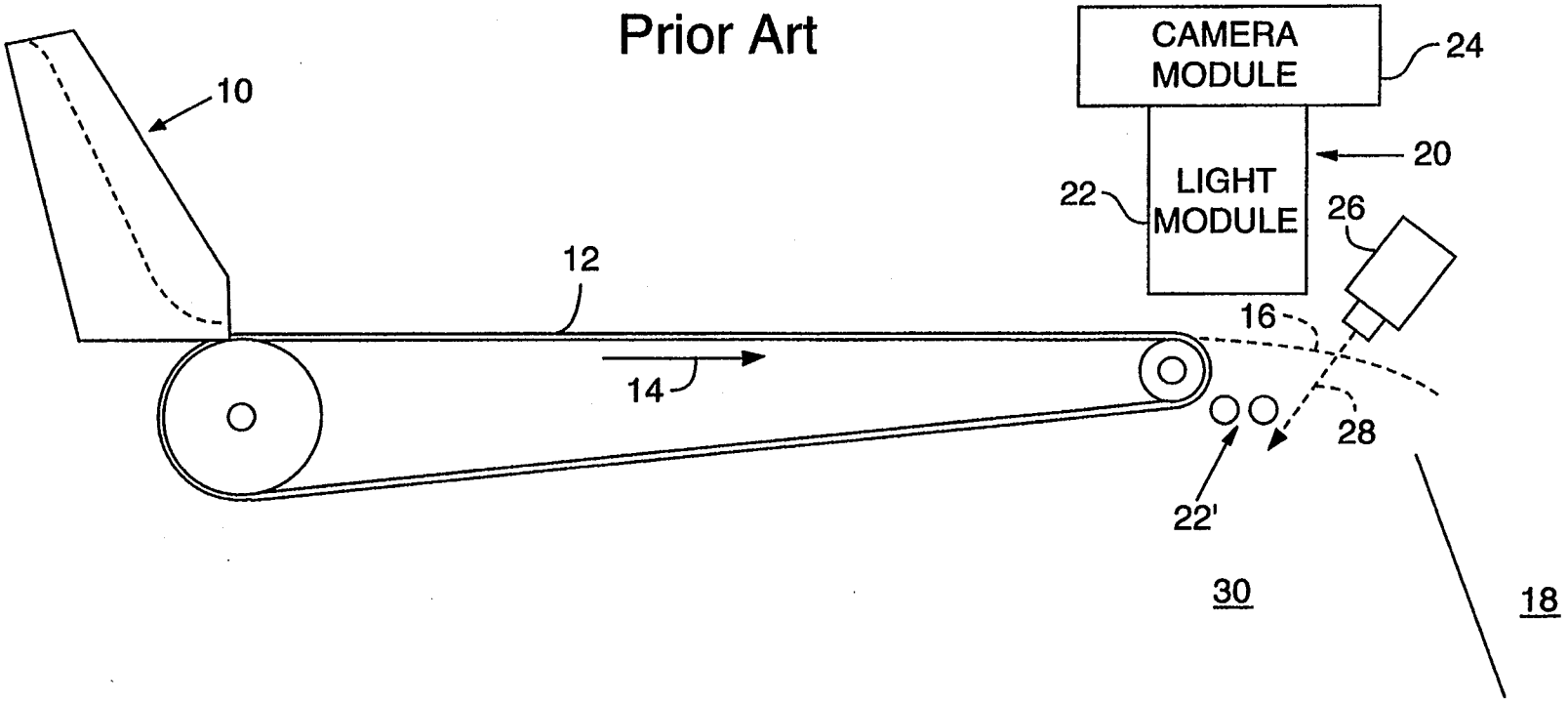
FIG. 1 Prior Art
FIG. 1 is a schematic side elevation view of a prior art automated bulk processing system including a conventional conveyor system.
Figure 2:
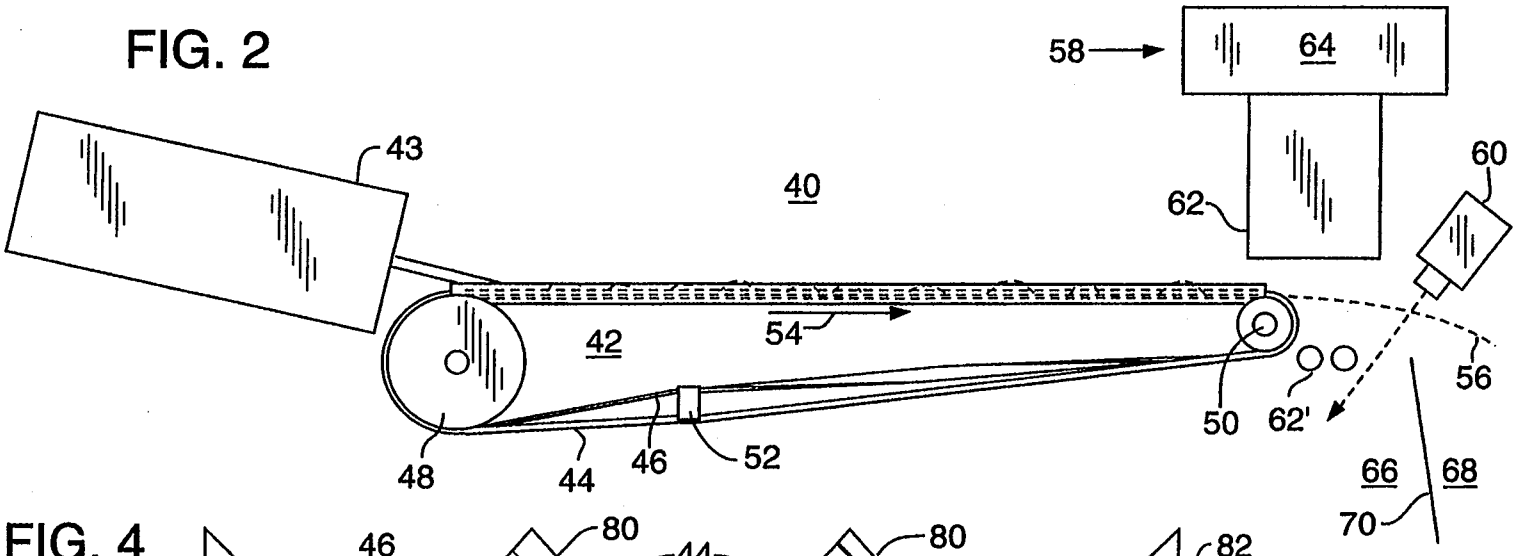
FIG. 2 is a schematic side elevation view of an automated bulk processing system including the conveyor system of the present invention.

An automated bulk processing system 40 of the present invention is illustrated in FIG. 2. Articles are delivered to conveyor system 42 by infeed system 43. In a preferred embodiment, infeed system 43 comprises a vibrating chute. However, infeed system 43 may alternatively employ an infeed conveyor belt or an inactive chute.

Conveyor system 42 includes one or more product lanes, each lane comprising two side belts 44 separated by a central product-carrying belt 46. Each belt forms a closed loop around a drive roller 48 and a spaced-apart, free-running end roller 50. Drive roller 48 preferably has a series of depressions or grooves that guide side belts 44. A comb 52 positioned on the underside of conveyor 42 separates side belts 44 from product-carrying belt 46. A motor (not shown) coupled to drive roller 48 drives belts 44 and 46 at high velocity in a direction 54. Articles are projected from conveyor system 42 in a normal trajectory to form an article flow path 56 and pass an off-belt optical inspection station 58 and an unacceptable article removal station or fluid ejection manifold 60.

Inspection station 58 includes a pair of light modules 62 and 62' that cooperate with a camera module 64 to identify selected optical characteristics of the articles as they pass from conveyor system 42. Inspection station 58 may identify the preselected characteristics of the articles, for example, in accordance with the methods and systems described in U.S. Pat. No. 5,085,325 of Jones et al. for Color Sorting System and Method, assigned to the assignee of the present application. In an alternative embodiment, inspection station 58 employs a first camera positioned below article flow path 56 which examines the leading edge of an elongated article, in conjunction with a second camera mounted above article flow path 56 which looks at the trailing edge of the article. Other types of inspection station are known in the art and may be employed with the conveyor system of the present invention.

Fluid ejection manifold 60 employs pressurized fluid, such as compressed air, to divert unacceptable articles from article flow path 56 towards a reject receiving location 66. The fluid ejection manifold is generally provided with a series of fixed or adjustable nozzles capable of accurately directing a blast of pressurized fluid such as compressed air. Adjustment of the nozzles and timing of fluid blasts can be controlled, for example, by a sorting control system that is integrated with the inspection system. Acceptable articles are received in an outfeed receiving location 68. An elongated separation panel 70 preferably separates reject receiving location 66 from outfeed receiving location 68.

Figure 3:
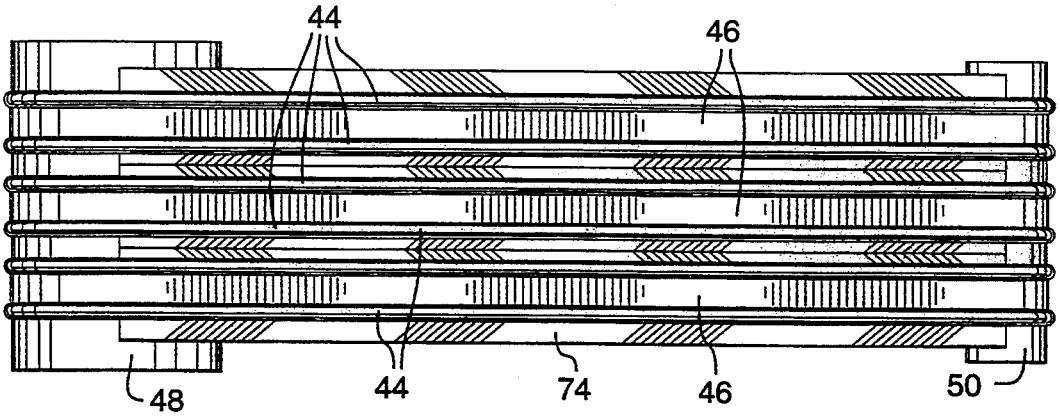
FIG. 3 is a top view of the conveyor system of the present invention.

In a preferred embodiment, the conveyor system of the present invention comprises multiple aligned product lanes each comprising two side belts 44 separated by a central product-carrying belt 46, as illustrated in FIG. 3. The illustrated embodiment employs three product lanes; however, more or fewer lanes could be utilized depending on the specific sorting requirements. Product-carrying belts 46 are preferably flat and slightly wider than the articles to be sorted. Side belts 44 are raised with respect to product-carrying belt 46, thereby defining a recessed area for product-carrying belt 46 into which articles are guided by side belts 44. Side belts 44 are preferably thicker than the thickness of product-carrying belt 46 and are preferably guided in recessed tracks to provide positive alignment. Belts 44 and 46 are preferably constructed of an unreinforced, non-stick material, such as urethane, and are stretched elastically (preferably 6–12%) when installed on the conveyor. In a preferred embodiment, side belts 44 are of round cross-section with a 0.965 cm diameter; and product-carrying belts 46 have a rectangular cross-section 1.90 cm wide by 0.198 cm thick. The embodiment of the present invention described herein employs side belts of circular cross-section; however, side belts of alternative cross-sectional configuration, such as square or oblong, may also be used.

Figure 4:
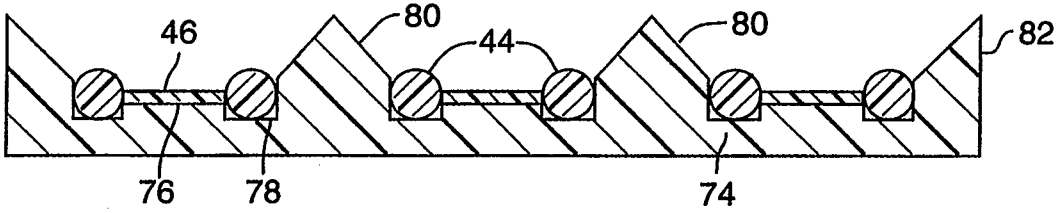
FIG. 4 is an enlarged cross-sectional view of the platen of the present invention showing the relative positions of the side and product-carrying belts.

The belts are supported by a routed tray or platen 74, preferably constructed of a strong, low friction material, such as ultra high molecular weight polyethylene material, which extends between drive roller 48 and end roller 50. As shown in FIG. 4, platen 74 comprises a series of product-carrying belt support surfaces 76 with a depression or guide 78 for a side belt on each side of support surface 76. Lane dividers 80 separate each lane of belts, and side members 82 hold the belts in position at the edge of platen 74. Lane dividers 80 and side members 82 extend above side belts 44 and are configured to direct articles into the product lanes and thus onto product-carrying belt 46. Preferably, lane dividers 80 are of triangular cross-section.

Figure 6:
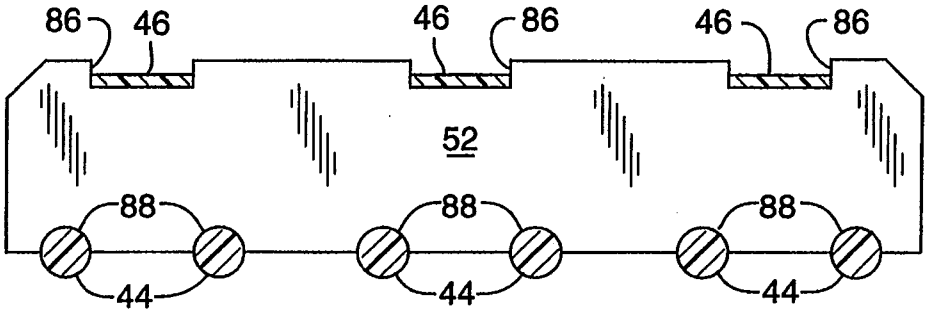
FIG. 6 is an enlarged cross-sectional view of the comb of the present invention showing the separation of the side and product-carrying belts.
Figure 5:
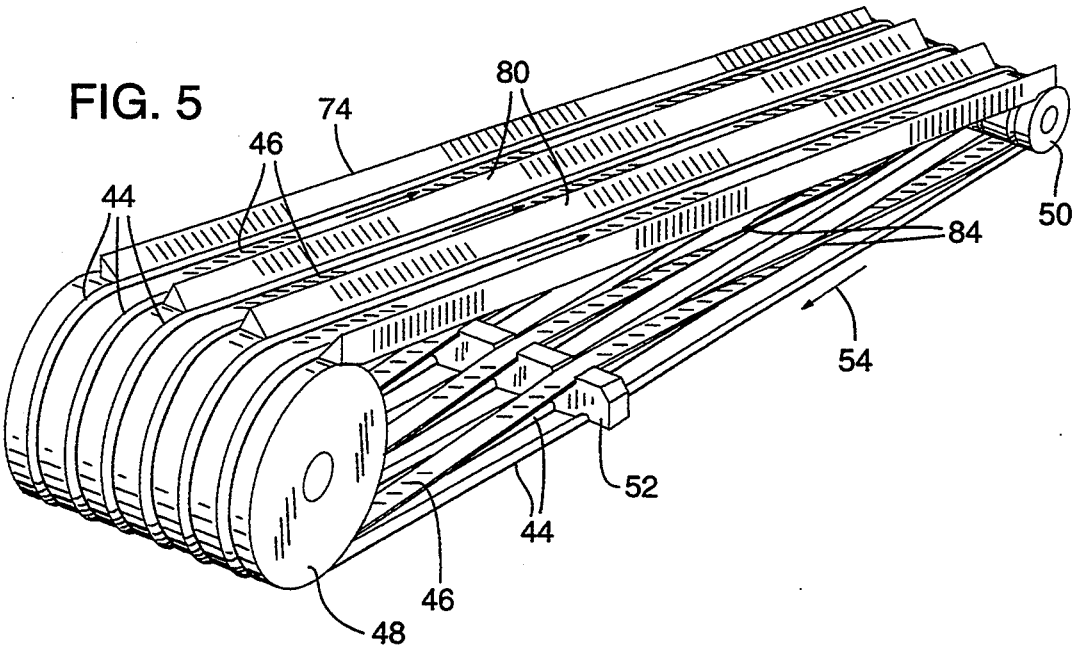
FIG. 5 is a perspective view of the conveyor system of the present invention showing the location of the 180° twist in the product-carrying belts.

As illustrated in FIG. 5, each product-carrying belt 46 has a 180° lengthwise twist 84 located on the underside of conveyor system 42, so that each of the two product-carrying surfaces of the belt are alternately presented on the upper surface of the conveyor for each complete belt travel cycle. This results in more efficient cleaning of the product-carrying belt 46. Cleaning may be accomplished by spraying water onto the underside of conveyor system 42. However, when belts constructed of urethane are employed, a water spray is normally not required, since articles do not tend to stick to the belts. Twist 84 is maintained in position on the underside of the conveyor system by means of comb 52, which also maintains product-carrying belt 46 and side belts 44 in the correct relative alignment. In a preferred embodiment illustrated in FIG. 6, product-carrying belts 46 pass through guides 86 on the upper surface of the comb while side belts 44 pass through guides 88 on the lower surface. The separation of the belts also by comb 52 serves to remove debris from between the margins of the belts, thereby facilitating cleaning of the conveyor system.

Figure 7:
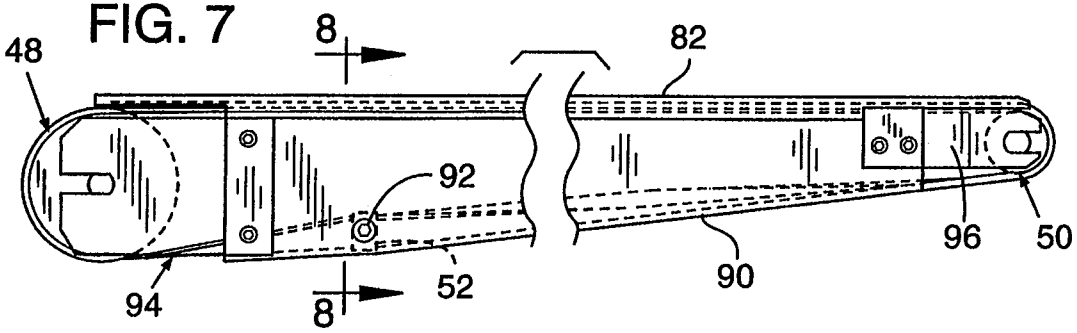
FIG. 7 is a side elevation view of the conveyor system of the present invention showing the attachment of the drive and end rollers.
Figure 8:
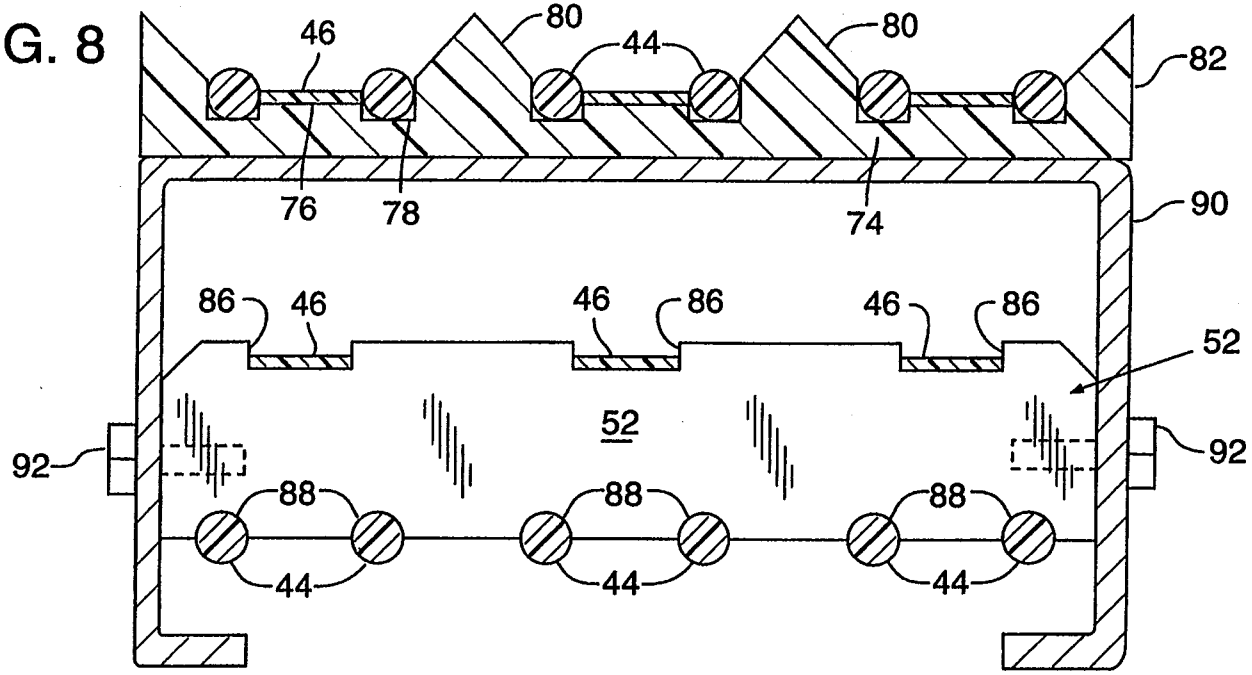
FIG. 8 is a cross-sectional view of the conveyor system of the present invention showing the attachment of the comb to the conveyor system.

As shown in FIGS. 7 and 8, platen 82 is mounted on top of a sheet metal framework or channel 90. Comb 52 is mounted between the vertical walls of channel 90 and held in place by bolts 92 passing through channel 90 and into comb 52. Drive roller 48 is attached to channel 90 by plates 94 extending between drive roller 48 and channel 90 on each side of conveyor 42. Similarly, end roller 50 is attached to channel 92 by plates 96.

In operation, article infeed system 43 delivers articles to be inspected and sorted, such as french fries, in random orientations to conveyor system 42. As the articles pass along the conveyor system, they are guided onto the surface of product-carrying belts 46 by side belts 44 and lane dividers 80, and are thus aligned in a single layer prior to being launched from the conveyor. The belts travel at a high enough velocity, typically within the range of 2.4 m/sec to 6.1 m/sec, to project the articles from the edge of product-carrying belt 46 in article flow path 56 toward outfeed receiving location 68. The articles traverse off-belt optical inspection station 56 where they are examined for uniformity of length and for defects. Unacceptable articles are removed from the article flow path at fluid ejection manifold 60 by means of a fluid blast and are directed into reject receiving location 66.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein may be varied considerably without departing from the basic principles of the invention.

I claim:

1. A conveyor system for transporting and aligning articles, comprising:

(a) two spaced-apart rollers, at least one of said rollers being a drive roller; and (b) at least one product lane comprising two side belts separated by a central product-carrying belt, each of said side belts being raised with respect to said product-carrying belt, and each of said side belts and said product-carrying belts forming a closed loop around said rollers and being driven by said drive roller, whereby articles are guided onto said product-carrying belt by said side belts and carried on said product-carrying belt.

2. A conveyor system for transporting and aligning articles as recited in claim 1 wherein said conveyor system has an upperside and an underside and said side belts are raised with respect to said central product-carrying belt along the length of said upperside of said conveyor system.

3. A conveyor system for transporting and aligning articles as recited in claim 1 wherein said product-carrying belt has a flat product-carrying surface.

4. A conveyor system for transporting and aligning articles as recited in claim 1 wherein said product-carrying belt and said side belts are of different cross-sectional configurations.

5. A conveyor system for transporting and aligning articles as recited in claim 1 wherein said side belts are of circular cross-section.

6. A conveyor system for transporting and aligning articles as recited in claim 1 wherein said side belts and said product-carrying belt are constructed of non-stick material.

7. A conveyor system for transporting and aligning articles as recited in claim 6 wherein said side belts and said product-carrying belt are constructed of urethane.

8. A conveyor system for transporting and aligning articles as recited in claim 1 comprising three product lanes.

9. A conveyor system for transporting and aligning articles as recited in claim 1 wherein said product-carrying belt has first and second product-carrying surfaces.

10. A conveyor system for transporting and aligning articles as recited in claim 9 wherein said flat belt has a 180° lengthwise twist so that said first and second product-carrying surfaces are alternately presented on the upper surface of the conveyor system for each complete belt travel cycle.

11. A conveyor system for transporting and aligning articles as recited in claim 1 further comprising a belt guide that separates said product-carrying belt from said side belts.

12. A conveyor system for transporting and aligning articles as recited in claim 11 wherein said belt guide comprises a comb having an upper surface and a lower surface with one or more belt grooves located on each of said upper and lower surfaces, said comb being located on the underside of the conveyor system.

13. A conveyor system for transporting and aligning articles as recited in claim 12 wherein said belt grooves on the upper surface of said comb match the configuration of said product-carrying belts and said belt grooves on the lower surface of said comb match the configuration of said side belts.

14. A conveyor system for transporting and aligning articles as recited in claim 1, wherein said drive roller has grooves in its surface matching the configuration and spacing of said side belts to guide said side belts.

15. A conveyor system for transporting articles, comprising:

(a) two spaced-apart rollers, at least one of said rollers being a drive roller; and (b) a multiplicity of belts for carrying said articles, each belt forming a closed loop around said rollers and being driven by said drive roller;

(c) a belt guide separating each of said belts from adjacent belts.

16. A conveyor system for transporting articles as recited in claim 15 in which said belt guide comprises a comb having an upper surface and a lower surface with one or more belt grooves located on each of said upper and lower surfaces, said comb being located on the underside of the conveyor system.

17. A conveyor system for transporting articles comprising:

(a) two spaced-apart rollers, at least one of said rollers being a drive roller;

(b) at least one belt for carrying said articles forming a closed loop around said rollers and being driven by said drive roller said belt having first and second product-carrying surfaces and being provided with a 180° lengthwise twist so that said first and second product-carrying surfaces are alternately presented for each complete belt travel cycle;

(c) a comb located on the underside of said conveyor system and having an upper surface and a lower surface with at least one belt groove located on said upper and lower surfaces, wherein said 180° lengthwise twist is maintained in position on the underside of said conveyor system.

18. An automated bulk processing system for inspecting and sorting articles, comprising:

(a) an article infeed system;

(b) a conveyor system from which articles are projected to form an article flow path, said conveyor system comprising two spaced-apart rollers, at least one of said rollers being a drive roller, and at least one product lane comprising two side belts separated by a product-carrying belt, said side belts being raised with respect to said product-carrying belt, each of said side belts and product-carrying belts forming a closed loop around said rollers and being driven by said drive roller, whereby articles are guided onto said product-carrying belt by said side belts and conveyed by said product-carrying belt;

(c) an outfeed receiving location for receiving said article flow path;

(d) an optical inspection station for identifying unacceptable articles; and (e) an unacceptable article removal station for removing unacceptable articles from said article flow path.

19. An automated bulk processing system for inspecting and sorting articles as recited in claim 18 wherein said side belts and said product-carrying belt are constructed of non-stick material.

20. An automated bulk processing system for inspecting and sorting articles as recited in claim 19 wherein said side belts and said product-carrying belt are constructed of urethane.

21. An automated bulk processing system for inspecting and sorting articles as recited in claim 18 wherein said product-carrying belt has a flat product-carrying surface.

22. An automated bulk processing system for inspecting and sorting articles as recited in claim 18 wherein said product-carrying belt has first and second product-carrying surfaces.

23. An automated bulk processing system for inspecting and sorting articles as recited in claim 22 wherein said product-carrying belt has a 180° lengthwise twist so that said first and second product-carrying surfaces are alternately presented for each complete belt travel cycle.

24. An automated bulk processing system for inspecting and sorting articles as recited in claim 18 further comprising a belt guide that separates said product-carrying belt from said side belts thereby removing debris from the margins of said product-carrying belt and said side belts.

25. An automated bulk processing system for inspecting and sorting articles as recited in claim 24 wherein said belt guide comprises a comb having an upper surface and a lower surface with one or more belt guides located on each of said upper and lower surfaces, said comb being located on the underside of said conveyor system.

26. An automated bulk processing system for inspecting and sorting articles, comprising:

(a) an article infeed system;

(b) a conveyor system from which articles are projected to form an article flow path, said conveyor system comprising two spaced-apart rollers, at least one of said rollers being a drive roller, a multiplicity of belts for carrying said articles, each belt forming a closed loop around said rollers and being driven by said drive roller, and a belt guide located on the underside of said conveyor system for separating and cleaning said belts;

(c) an outfeed receiving location for receiving said article flow path;

(d) an optical inspection station for identifying unacceptable articles; and (e) an unacceptable article removal station for removing unacceptable articles from said article flow path.

27. An automated bulk processing system for inspecting and sorting articles as recited in claim 26 in which said belt guide comprises a comb having an upper surface and a lower surface with one or more belt grooves located on each of said upper and lower surfaces.

28. An automated bulk processing system for inspecting and sorting articles comprising:

(a) an article infeed system;

(b) a conveyor system from which articles are projected to form an article flow path, said conveyor system comprising two spaced-art rollers, at least one of said rollers being a drive roller, at least one belt for conveying said articles forming a closed loop around said rollers and being driven by said drive roller, said belt having a first and a second-product carrying surface and being provided with a 180° lengthwise twist so that said first and second product-carrying surfaces are alternately presented from each complete belt travel cycle, a comb having an upper surface and a lower surface with at least one belt groove located on said upper and lower surfaces, wherein said 180° lengthwise twist is maintained in position on the underside of said conveyor system, said comb being located on the underside of said conveyor system;

(c) an outfeed location for receiving said article flow path;

(d) an optical inspection station for identifying unacceptable articles; and (e) an unacceptable article removal station for removing unacceptable articles from said article flow path.

29. A conveyor system for transporting and aligning articles, comprising:

(a) two spaced-apart rollers, at least one of said rollers being a drive roller;

(b) at least one product lane comprising two lane dividers separated by a central product-carrying belt, each of said lane dividers being raised with respect to said product-carrying belt, whereby articles are guided onto said product-carrying belt by said lane dividers& said product-carrying belt forming a closed loop around said rollers and being driven by said drive roller, said product carrying belt having first and second product-carrying surfaces and a 180° lengthwise twist so that said first and second product-carrying surfaces are alternately presented for each complete belt travel cycle; and (c) a comb having an upper surface and a lower surface with at least one belt groove located on said upper and lower surfaces wherein said 180° lengthwise twist is maintained in position on the underside of said conveyor system, said comb being located on the underside of said conveyor system.

* * * * *